US007600707B2

(12) United States Patent
Wingerson

(10) Patent No.: US 7,600,707 B2
(45) Date of Patent: Oct. 13, 2009

(54) APPARATUS FOR THE SEPARATION AND TREATMENT OF SOLID BIOMASS

(75) Inventor: Richard C. Wingerson, Sandpoint, ID (US)

(73) Assignee: PureVision Technology, Inc., Fort Lupton, CO (US)

( * ) Notice: Subject to any disclaimer, the term of this patent is extended or adjusted under 35 U.S.C. 154(b) by 34 days.

(21) Appl. No.: 11/158,831

(22) Filed: Jun. 21, 2005

(65) Prior Publication Data

US 2006/0283995 A1 Dec. 21, 2006

(51) Int. Cl.
*B02C 19/00* (2006.01)

(52) U.S. Cl. ..... 241/65; 241/260.1

(58) Field of Classification Search ..... 241/28, 241/23, 260.1, 65; 162/18, 19, 60; 127/37
See application file for complete search history.

(56) References Cited

U.S. PATENT DOCUMENTS 4,214,947 A * 7/1980 Berger ..... 162/18
4,316,748 A * 2/1982 Rugg et al. ..... 127/37
4,363,671 A * 12/1982 Rugg et al. ..... 127/1
6,620,292 B2 * 9/2003 Wingerson ..... 162/19

* cited by examiner

*Primary Examiner*—Mark Rosenbaum
(74) *Attorney, Agent, or Firm*—Don D. Cha; Hamilton DeSanctis & Cha, LLP

(57) ABSTRACT

An apparatus to separate components of a solid feedstock is described. The apparatus may include a threaded shaft that has a plurality of reaction zone segments along the length of the shaft that are separated from each other by dynamic plug segments. The threads of the shaft have a first thread pitch in the reaction zone segments, and a second thread pitch in the dynamic plug segments. The apparatus may also include a motor to rotate the shaft, and an outlet coupled to a second end of the shaft, where one or more solid components of the solid feedstock exit the apparatus through the outlet. The apparatus may additionally include a feeder to supply the solid feedstock to the threaded shaft, and a pump to provide a rinse fluid to the threaded shaft, where the rinse fluid flows in the opposite direction of the solid feedstock along the shaft.

11 Claims, 8 Drawing Sheets

APPARATUS FOR THE SEPARATION AND TREATMENT OF SOLID BIOMASS

CROSS-REFERENCES TO RELATED APPLICATIONS

This application is related to U.S. Pat. No. 6,419,788, issued Jul. 16, 2002 to Wingerson, and titled "Method of Treating Lignocellulosic Biomass to Produce Cellulose," and is also related to U.S. Pat. No. 6,620,292, issued Sep. 16, 2003 to Wingerson, and titled "Cellulose Production from Lignocellulosic Biomass," the entire contents of both patents of which are herein incorporated by reference for all purposes.

BACKGROUND OF THE INVENTION

Natural cellulosic feedstocks typically are referred to as "biomass". Many types of biomass, including wood, paper, agricultural residues, herbaceous crops, and municipal and industrial solid wastes derived from crops have been considered as feedstocks for the manufacture of a wide range of goods. These biomass materials consist primarily of cellulose, hemicellulose, and lignin bound together in a complex gel structure along with small quantities of extractives, pectins, proteins, and ash. Due to the complex chemical structure of the biomass material, microorganisms and enzymes cannot effectively attack the cellulose without prior treatment because the cellulose is highly inaccessible to enzymes or bacteria. This inaccessibility is illustrated by the inability of cattle to digest wood with its high lignin content even though they can digest cellulose from such material as grass. Successful commercial use of biomass as a chemical feedstock depends on the separation of cellulose from other constituents.

The possibility of producing sugar and other products from cellulose has received much attention. This attention is due to the availability of large amounts of cellulosic feedstock, the need to minimize burning or landfilling of waste cellulosic materials, and the usefulness of sugar and cellulose as raw materials substituting for oil-based products. Other biomass constituents also have potential market values.

The separation of cellulose from other biomass constituents is difficult, in part because the chemical structure of lignocellulosic biomass is so complex. See, e.g., ACS Symposium Series 397, "Lignin Properties and Materials", edited by G. W. Glasser and S. Sarkanen, published by the American Chemical Society, 1989, which includes the statement that "[L]ignin in the true middle lamella of wood is a random, three-dimensional network polymer comprised of phenylpropane monomers linked together in different ways. Lignin in the secondary wall is a nonrandom two-dimensional network polymer. The chemical structure of the monomers and linkages which constitute these networks differ in different morphological regions (middle lamella vs secondary wall) different types of cell (vessels vs fibers) and different types of wood (softwoods vs hardwoods). When wood is delignified, the properties of the macromolecules made soluble reflect the properties of the network from which they are derived." The separation of cellulose from other biomass constituents is further complicated by the fact that lignin is intertwined and linked in various ways with cellulose and hemicellulose both of which are polymers of sugars. Thus there is a need for systems and methods for separating solid biomass (such as lignocellulosic biomass) into its constituent components and treating the components to make useful products. These and other needs are addressed by the present invention.

BRIEF SUMMARY OF THE INVENTION

Embodiments of the invention include an apparatus to separate components of a solid feedstock. The apparatus includes a threaded shaft contained by a barrel unit, where the threaded shaft has a plurality of reaction zone segments along the length of the shaft that are separated from each other by dynamic plug segments. The threads of the shaft can have a first thread pitch in the reaction zone segments, and a second thread pitch that is less than the first thread pitch in the dynamic plug segments. The apparatus may also include a motor coupled to a first end of the threaded shaft to rotate the shaft, and an outlet coupled to a second end of the shaft that is opposite the first end, where the solid feedstock moves in a direction from the first to the second end of the shaft when the motor rotates the shaft. One or more solid components of the solid feedstock exit the apparatus through the outlet. The apparatus may still further have a feeder to supply the solid feedstock to the threaded shaft, where the solid feedstock from the feeder first contacts the threaded shaft at a first reaction zone segment that is closest to the first end of the shaft, and a pump to provide a rinse fluid to the threaded shaft, wherein the rinse fluid flows in the opposite direction of the solid feedstock along the shaft.

Embodiments of the invention may also include an apparatus to treat a solid feedstock. The apparatus may include a threaded shaft having a first end and a second end opposite the first end, where a motor is coupled to the first end to rotate the shaft, and an outlet is coupled to the second end, and the solid feedstock moves in a direction from the first to the second end of the shaft when the motor rotates the shaft. One or more solid components of the solid feedstock exit the apparatus through the outlet. The apparatus may also include an inlet to supply the solid feedstock to the threaded shaft, and a pump to provide a rinse fluid to the threaded shaft, where the rinse fluid flows in the opposite direction of the solid feedstock along the shaft. The apparatus may further include a dynamic filter to capture particles from a portion of the rinse fluid coming off the shaft, and return the particles to the threaded shaft.

Embodiments of the invention may still further include a system to treat a solid feedstock. The system may include a plurality of threaded shafts including a first shaft coupled to a motor to rotate the shaft, and a final shaft coupled to an outlet, where the solid feedstock moves in a direction from the first shaft to the final shaft, where one or more solid components of the solid feedstock exit the system through the outlet. The system may also include a feeder to supply the solid feedstock to the first shaft, and a pump to provide a rinse fluid to one or more of the plurality of the threaded shafts, where the rinse fluid flows in the opposite direction of the solid feedstock along the shafts.

Additional embodiments and features are set forth in part in the description that follows, and in part will become apparent to those skilled in the art upon examination of the specification or may be learned by the practice of the invention. The features and advantages of the invention may be realized and attained by means of the instrumentalities, combinations, and methods described in the specification.

DETAILED DESCRIPTION OF THE INVENTION

Figure 1:
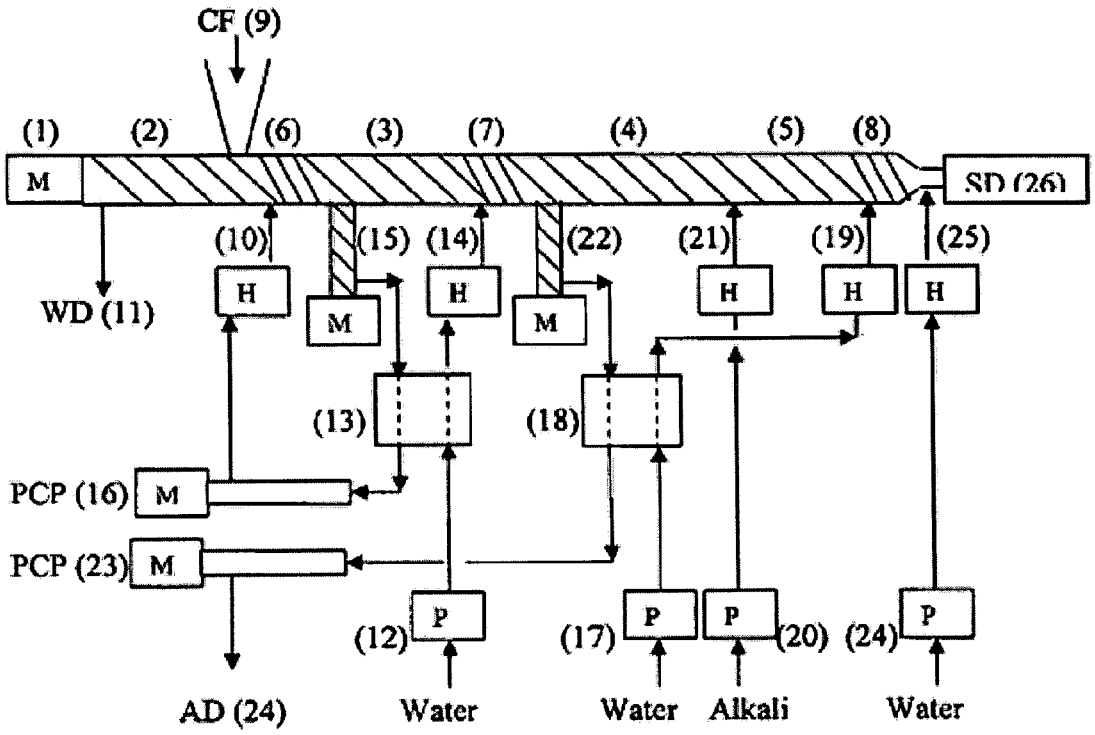
FIG. 1 is a schematic illustrating a continuous, counterflow system incorporating the features of the present invention in the production of cellulose from lignocellulosic biomass according to an embodiment of the invention.

An improved apparatus is described for counter-flow extraction of materials including, but not limited to, the separation of cellulose fibers from other constituents of lignocellulosic biomass such as found in trees, grasses, shrubs, agricultural waste, and waste paper for use in the manufacture of paper, plastics, ethanol, and other chemicals. This apparatus integrates continuous, multiple processing steps that may include chemical reactions with mixing at elevated temperature and/or pressure, filtration at elevated temperature and/or pressure, controlled discharge of liquid and solid products, steam explosion, and energy recuperation.

Embodiments of an apparatus according to the invention may include one or more twin-screw extruders used as physio-chemical reactors for processing a solid feedstock, such as solid organic biomass. Means are provided for feeding the feedstock into the extruder. Embodiments of the apparatus include a twin screw extruder having cavities formed by the interlocking screws, and these cavities progress through the extruder barrel carrying with them the feedstock. Reaction/retention time may be determined by the pitch of the screws, the rotation rate of the screws, and the length of the screws in the barrel.

Screws can be configured for different functions in different parts of the reactor. Long pitch screws with cavities loosely filled are used for transport of the feedstock while reactions occur. If the screw pitch is decreased progressively over a distance of a few screw diameters, feedstock in the cavities will be compressed to produce a tight dynamic plug at this short pitch location. Beyond the plug location, long pitch screws will again have their cavities loosely filled. The plugs will be dynamic with fresh feedstock being continuously forced into the plug zone and compressed plug material being continuously broken up as it progresses into the following long-pitch zone. Plug formation involves large shearing forces that decompose fibrous feedstock, thereby reducing energy needed for feedstock preparation and making it more susceptible to chemical processing.

Two plugs can be formed at different locations along the extruder length to create a reaction zone between them. The plugs can be made tight enough to contain up to about one thousand psi of pressure or more if the desired physio-chemical processing should so require. The apparatus may include a plurality of plugs, (e.g., two or more plugs). Additional plugs can be formed so that the feedstock material progresses through a sequence of processing steps. The plugs can easily reduce moisture content to 50% as the feedstock passes through them. Thus the plugs serve not only as separators between reaction zones, but they can also supplement (or substitute) for the role played by filters in separating liquids from solids between processing steps.

Dimensional tolerances in a quality twin-screw extruder may be small, allowing for the continuous counter-flow of liquid reactants against the direction of movement of the feedstock solids. In the counter-flow operation, feedstock component particles larger than the dimensional tolerance are carried in the screw cavities, while the liquid flows through the cracks in the opposite direction. Counter-flow provides a highly efficient mode of extraction that may be combined with chemical reactions by providing suitable reagents in the liquid. In some embodiments, a "reaction zone" may be a counter-flow water wash to remove residual chemicals from a previous physio-chemical reaction zone. In additional embodiments, a reaction zone may employ co-flow or plug flow by positioning liquid input and discharge ports. Some feed materials may not require continuous screws in transport zones. A plurality of alternations along the barrel between screws and no screws will allow controlled compaction of material thereby increasing residence time and reducing capital costs per unit of throughput with only modest increase in counter-flow pressure drop.

In a continuous counter-flow reaction zone, liquid must be discharged while retaining solids in the reactor. This can be a problem since the counter-flowing liquid can carry with it any particles smaller than the dimensional tolerances of the screw/barrel system. These small particles in combination with the larger particles at the position of liquid discharge may clog a static filter system. The solution to this problem is a self-cleaning, dynamic filter system comprising a miniature, twin-screw extruder that forces solids back into the main reaction zone while allowing liquid (with its load of fine particles) to discharge in counter-flow. The combination of "dewatering" action by the dynamic plug and dynamic filtration of discharging liquid provides in situ solid/liquid separation equivalent to conventional filtration.

Applications of the invention include operation at elevated temperature and/or pressure. In some of these applications, neither liquid nor solids are discharged directly to atmospheric pressure without upsetting reaction zones or plugs, as a portion of the discharging material flashes to vapor. Pressure may be maintained and controlled as the material is discharged, but spring loaded devices commonly used for this purpose can clog with the particulates in the two-phase slurry discharges. The clogging problem may be addressed in the present invention with a variety of techniques.

In one technique, material can be discharged in bursts by means of a system of two valves preceded by a hydrolyic accumulator. In this system, discharging material is accumulated with a concomitant increase in pressure. When the pressure reaches a set point, the first valve is opened briefly to fill the space between the valves. The second valve is then opened briefly with compressed air being used to blow material out of the space between the valves. The valve action results in a pressure drop in the accumulator determined by the relative free volume in the accumulator and the volume in the space between valves. Discharging material again builds pressure in the accumulator and the cycle repeats. This discharge system is especially useful when flashing of the discharged material is required or desired as a feature of the overall biomass processing.

In another technique, material can be discharged continuously and controllably by use of a positive displacement pump run in reverse with speed regulated by pressure in the reaction zone. Piston pumps, gear pumps, and progressing cavity pumps may all be used with the systems and apparatuses of the invention. Discharging material may first be cooled by, for example, heat exchange and/or dilution with a cold liquid stream.

The twin-screw extruders may include a plurality of reaction zones with a plurality of reaction times. If a single extruder is long enough to experience bending and twisting under torque, the same number and length of reaction zones may be accommodated by two or more separate extruders that are coupled together. This limits the screw length of any one extruder while retaining the advantages of a single pressurized vessel with multiple, interconnected, reaction zones.

Another advantage of the invention is that the temperature in a counter-flow reaction zone need not be uniform. This can be used when the apparatus or system is being used, for example, to extract hemicellulose from biomass. Hemicellulose is mobilized by hydrolysis of the natural hemicellulose polymer. The soluble sugar monomers and oligomers formed are subject to further decomposition to undesirable products, and this is a serious limitation in batch or plug-flow processing. In the apparatus of the present invention, a temperature gradient can be established such that the solids being processed progress into continuously more severe conditions while the mobilized sugars in counter-flow are carried into continuously less severe conditions thereby minimizing further degradation.

The present invention relates to apparatus having a variety of features that may be convenient and/or necessary for the processing of biomass or other material to produce intermediate products having a variety of applications as feedstock in the production of finished goods. The various features can be used in a variety of configurations and combinations to meet particular processing needs. To illustrate aspects of the invention, an embodiment of an apparatus according to the invention will be described which is called a process development unit (PDU).

A simplified schematic of the PDU is shown in FIG. 1. A motor driven (1), twin-screw extruder is divided into four reaction zones (2), (3), (4), and (5) by dynamic plugs (6), (7), and (8). In some embodiments, the threaded shaft used in the screw extruder may be made by modifying a commercially available component, such as an extruder used in plastics and food extrusion manufactured by Entek Corporation with screw diameter of 27 mm, screw length of 1330 mm, rotating at 50 rpm.

Figure 2:
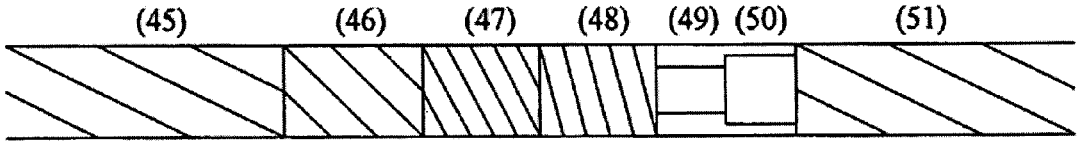
FIG. 2 is a schematic detailing a preferred screw configuration for the formation of a dynamic plug extruder according to an embodiment of the invention.

FIG. 2 is a schematic detailing a threaded shaft configuration for the formation of a dynamic plug in a 27 mm extruder. Solids being processed proceed from left to right. (45) and (51) represent parts of transport screws with screw pitch of 45 mm. (46), (47), and (48) represent the compression zone with each screw element being 30 mm long. (46) has a pitch of 30 mm; (47) has a pitch of 20 mm; and (48) has a pitch of 15 mm. (49) and (50) represent the plug zone, and are smooth cylinders: (49) being 20 mm in diameter by 15 mm long and (50) being 23 mm in diameter by 15 mm long. Following this compression zone is a 30 mm length of smooth (unthreaded) shaft to form a seal before resumption of the 45 mm pitch. A screw driven crammer/feeder (9) is used to force feedstock into the extruder. The crammer/feeder is in turn fed by an Acrison loss-of-weight feeder (not shown).

Referring again to FIG. 1, the first reaction zone (2), a counterflowing rinse fluid (e.g., water, and aqueous solution, etc.) may be maintained at a temperature of 90° C. by a heater (10) that may also be used to wet incoming solid feedstock from the crammer/feeder (9) and to wash fines from this feedstock. This zone operates at atmospheric pressure and the rinse fluid discharges as an overflow to maintain a constant liquid level. This fluid discharge (11) may contain soluble components from the feedstock (e.g., depolymerized hemicellulose, lignin, and extractives, in the case of lignocellulosic biomass) as well as insoluble particles and fines.

In this example, the second reaction zone (3) operates under pressure at temperatures up to 230° C. Water for counter-flow is fed by a high pressure piston pump (12) through a heat exchanger (13) and a heater (14). The counter-flowing water is restricted by the dynamic plugs (6) and (7) formed from the material being processed, and is discharged through the dynamic filter (15), the heat exchanger (13), and a progressing cavity pump (16) operated in reverse. This water solution is used as the wetting/washing agent in the first reaction zone (2) in order to avoid product dilution that would occur from the use of fresh water. The plugs carry some liquid between reaction zones just as any filter would. In some applications, the feedstock may be naturally wet enough that additional wetting from the pump (16) is not needed. The heat exchanger (13) serves both to cool the liquid output to prevent flashing and to recycle heat to the liquid feed for energy conservation.

The third (4) and fourth (5) reaction zones operate under pressure at temperatures up to 235° C. and illustrate a situation in which two reaction zones do not need to be separated by a dynamic plug. Fresh water for counter-flow is fed by a high pressure piston pump (17) through a heat exchanger (18) and a heater (19). This water rinses the products prior to their discharge through dynamic plug (8). A concentrated alkali solution may be fed at an appropriate rate by pump (20) through a heater (21) to mix with the counter-flowing water rinse from the fourth reaction zone (5). This mix then provides the liquid feed to the third reaction zone (4) in which base assisted or catalyzed reactions may occur (e.g., depolymerization of lignin and residual hemicellulose). This method of utilizing rinse water conserves chemicals and minimizes waste disposal problems at no additional cost for heating and pumping. In the same manner as in the second reaction zone (3), the counter-flowing solution from the third reaction zone (4) is discharged through the dynamic filter (22), the heat exchanger (18), and a progressing cavity pump (23). This alkali discharge (24) may contain alkali reaction products (e.g., depolymerized lignin and hemicellulose) as well as particulates and fines.

Particulates below particular sizes may be carried in a stream of rinse fluid and not with the larger solid particles. These small particles should be discharged with the liquid so they do not accumulate and clog the filter system. Embodiments of the present invention include a dynamic filter, which may be produced by modifying a unit called a "vacuum stuffer" that is manufactured by Entek Manufacturing. The vacuum stuffer unit includes a twin-screw extruder fabricated with close tolerances.

Figure 3A:
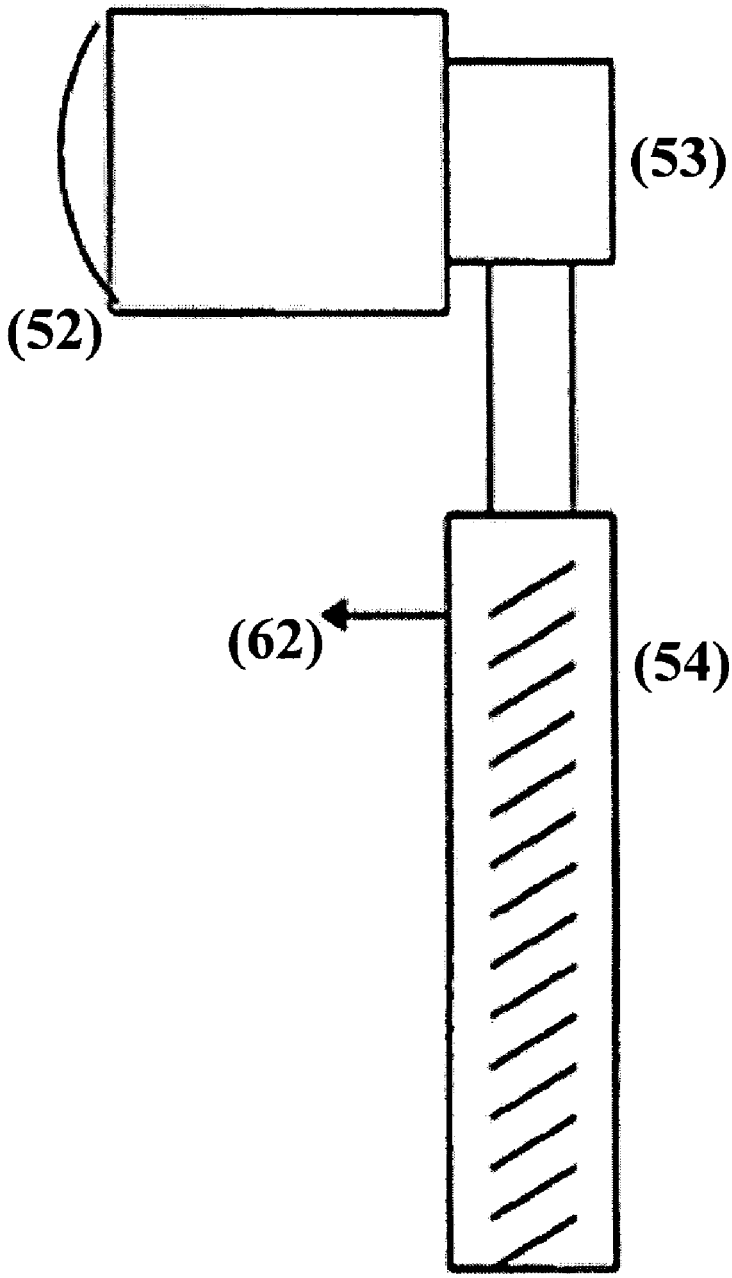
FIG.3A is a schematic of a twin-screw, self-cleaning filter for use in discharging product liquid according to an embodiment of the invention.

FIG. 3A is a schematic of a twin-screw, self-cleaning filter for use in discharging product liquid according to an embodiment of the invention. This unit consists of a motor (52) with speed control, a gear speed reducer (53), and a co-rotating, twin-screw "extruder" (54) with screw diameter 22 mm, screw pitch 20 mm and screw length 220 mm. The filter screws penetrate the main extruder barrel perpendicularly to within 2 mm of the processing screws. Liquid product is discharged at (62). Filtering action occurs in the space between the screws and the barrel wall that allows liquid and fines to flow counter to the direction of screw action. The screws may have many turns, with each turn acting as an additional filter in series to catch larger particles that may occasionally leak through any one turn. The screw action then returns these larger particles to the main extruder so that there is no need to clean the filters. In the example described, the vacuum stuffer has screws with 22 mm diameter and 220 mm length rotating at about 10 to about 30 rpm.

Figure 3B:
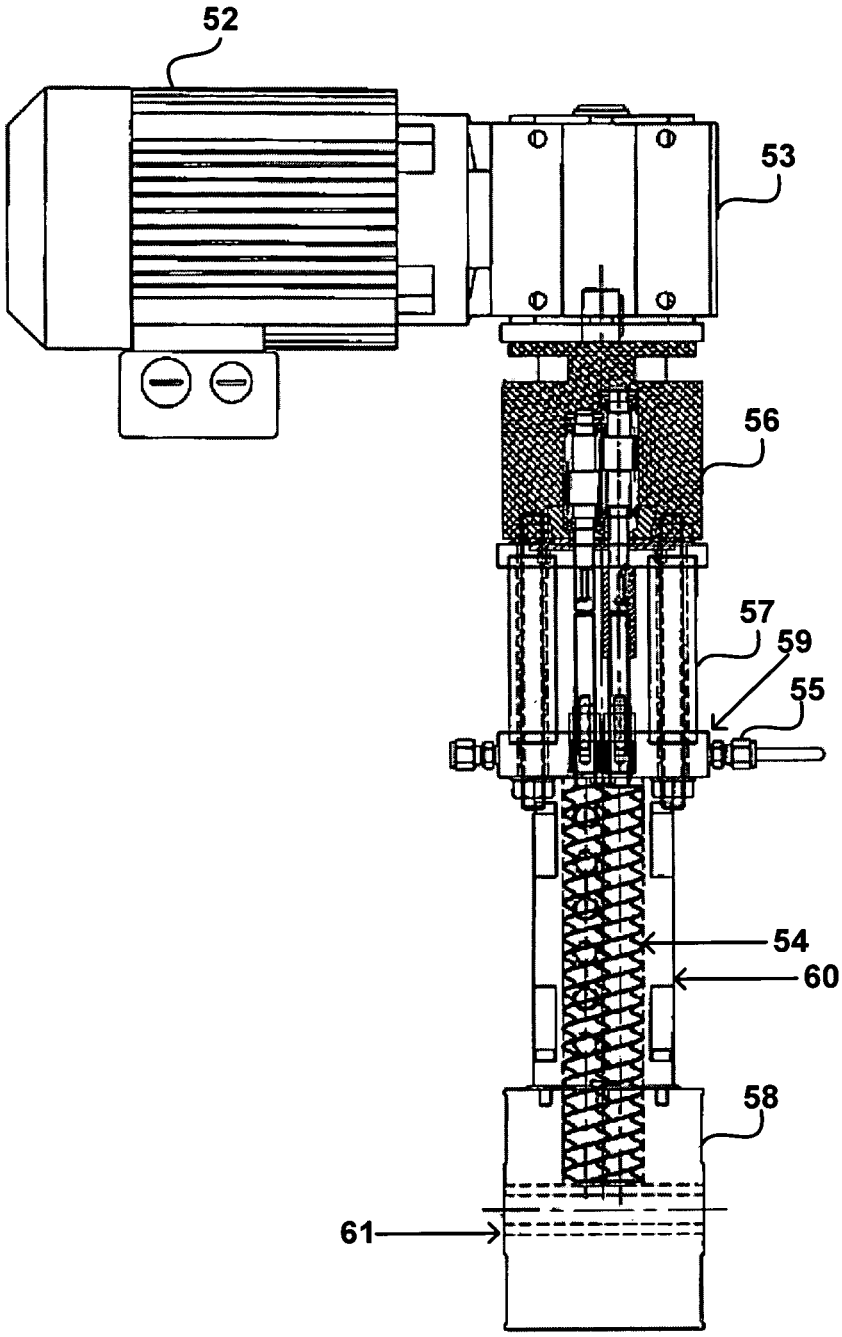
FIG. 3B shows a vacuum stuffer component according to an embodiment of the invention.

FIG. 3B shows additional details of the vacuum stuffer component in FIG. 3A. The variable speed motor (52) drives the gear speed reducer (53), which in turn drives the gear unit (56) to provide power for twin drive shafts for the twin filter screws (54). A spacer (57) is provided to isolate the gear unit (56) from the high temperature of the liquid being discharged. The twin drive shafts pass through a water-cooled sport plate (59) that contains the shaft seals to retain the pressure of the liquid discharge. Water cooling (55) of the support plate (59) protects the shaft seals. The barrel of the twin-screw dynamic filter (60) attaches to the barrel (58) of the main extruder apparatus, with the filter screws (54) penetrating to within 2 mm of the main extruder screws (61).

Two methods have been developed for the discharge of solids: If solids exiting the last dynamic plug are too dry to be managed, water may be added in a mixing zone (25) of the extruder to create a slurry. This slurry can then be injected into a progressing cavity pump operated in reverse to reduce the pressure much as with the liquid discharge previously described (23). The water added may be cold to keep the vapor pressure of the resulting slurry lower than atmospheric pressure as the slurry enters the pump.

Figure 4:
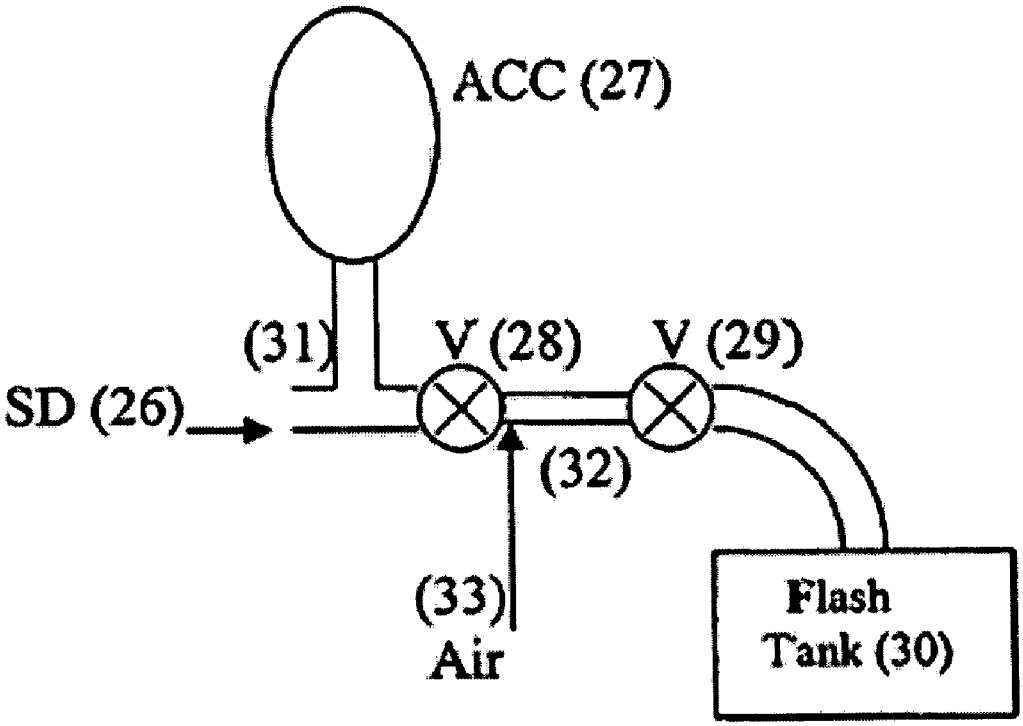
FIG. 4 is a schematic illustrating a double-valve system for releasing a pressurized slurry to atmospheric pressure according to an embodiment of the invention.

In some applications, further disruption of the components of the feedstock may be desired. Embodiments of the present invention provide for additional disruption of the feedstock with a steam explosion. In this case, slurry water (25) is added hot (e.g., greater than 130° C.) and a component like the pressurized discharge unit shown in FIG. 4 is used to reduce pressure explosively. In this example, a hydrolyic accumulator (27) is precharged to 150 psi., and water (25) is injected to obtain operating pressure. As solids (26) discharge, they flow toward (31) the accumulator and simultaneously increase the accumulator pressure. At a preset pressure, which may depend on operating temperature, a valve sequence is triggered. At the beginning of the sequence, valves (28) and (29) are both closed. Valve (28) opens and the chamber (32) between the valves fills with slurry as the accumulator pressure falls below the set point. Valve (28) then closes and valve (29) opens. The sudden release of pressure causes part of the water in the slurry to flash to steam in an explosion that discharges the remaining material into the flash tank. Valve (29) then closes to await another rise in accumulator pressure and the initiation of another valve sequence. During startup when the temperature may be too low for a steam explosion, an air supply (33) protected by a check valve may be triggered simultaneously with the opening of valve (29) to eject material from chamber (32).

Figure 5:
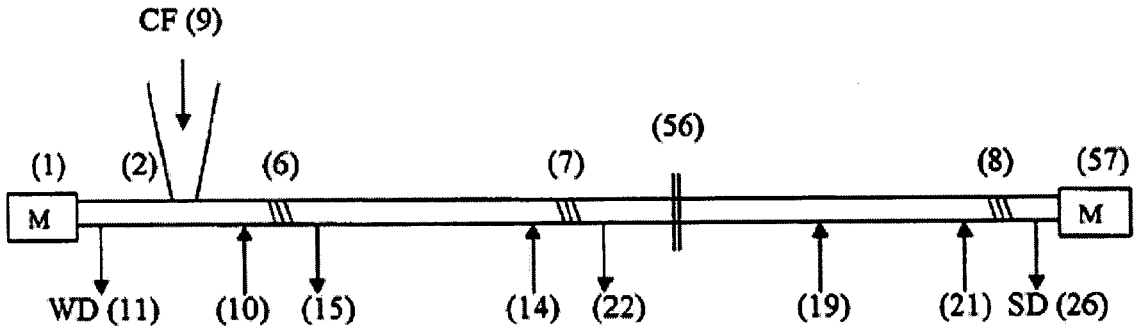
FIG. 5 is a schematic illustrating the use of two extruders to overcome the torque limitations of long extruders that may be needed for long reaction times according to an embodiment of the invention.

As noted above, embodiments of the invention also include systems and apparatuses with two or more separate extruders that are coupled together. FIG. 5 is a schematic illustrating the use of two extruders to overcome the torque limitations of long extruders that may be needed for long reaction times. Flanges (56) join the two extruder barrels, and there is a second drive motor (57).

Figure 6:
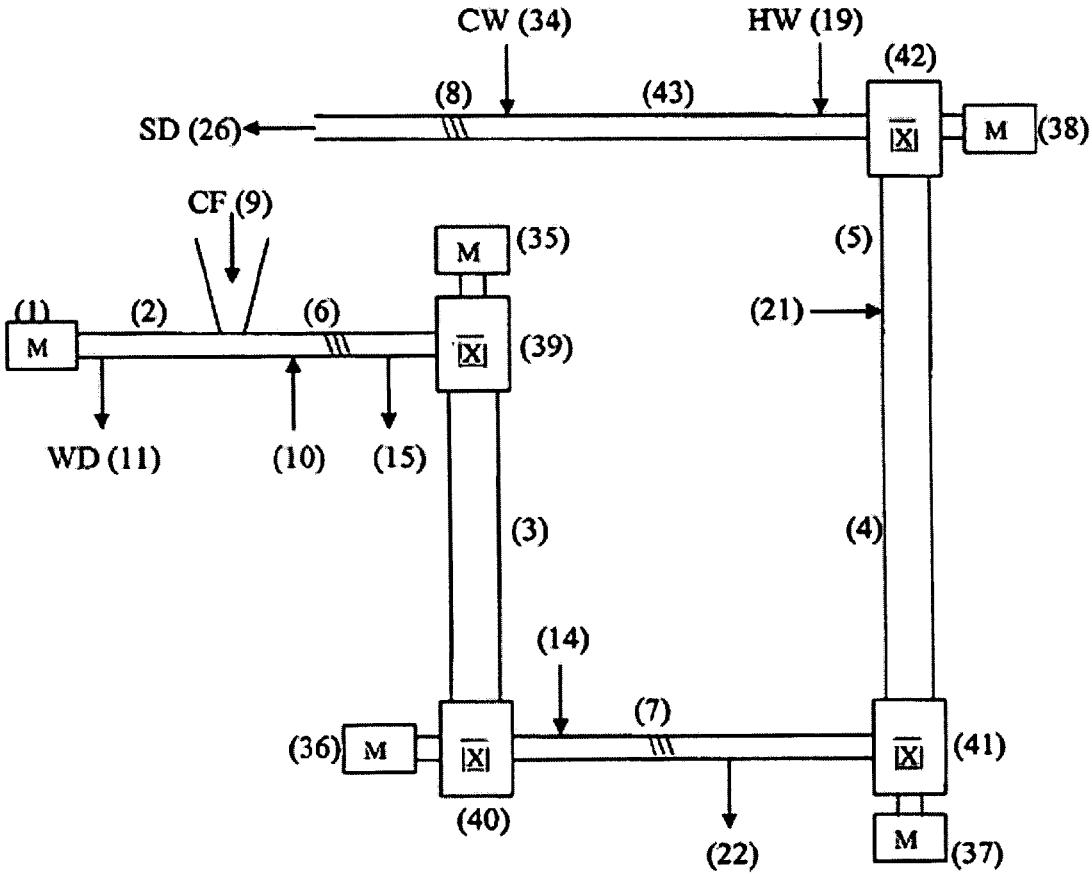
FIG. 6 is a schematic illustrating the use of multiple extruders to overcome the torque limitations of long extruders needed for long reaction times according to an embodiment of the invention.

FIG. 6 shows another embodiment of a system according to the present invention where a plurality of extruder units may be coupled together to make a larger scale system. The system shown here includes five threaded shaft extruders, where each of the extruders is similar to the one shown in FIG. 1.

FIG. 6 includes a motor driven extruder (1). The principle auxiliary units are the screw-driven crammer/feeder (9), heated liquid (10) to wet the incoming feed, a first dynamic plug (6), and a first dynamic filter (15). The operation of these components may be similar to the operation described for the apparatus of FIG. 1, and the system may be a relatively small extruder operated at comparatively high speed when a reaction zone requiring long retention time is not included. For small diameter extruders, smaller dynamic plugs may be formed that require less torque on the threaded shafts, and create less wear on the apparatus.

In FIG. 6, the second reaction zone (3) is implemented as a separate motor-driven extruder (35). This extruder can be larger in order to achieve a retention time required by a particular application, but since less torque is needed to mix and transport solids, the drive system for the extruder may be lighter and less costly than used in conventional large extruders.

Figure 7:
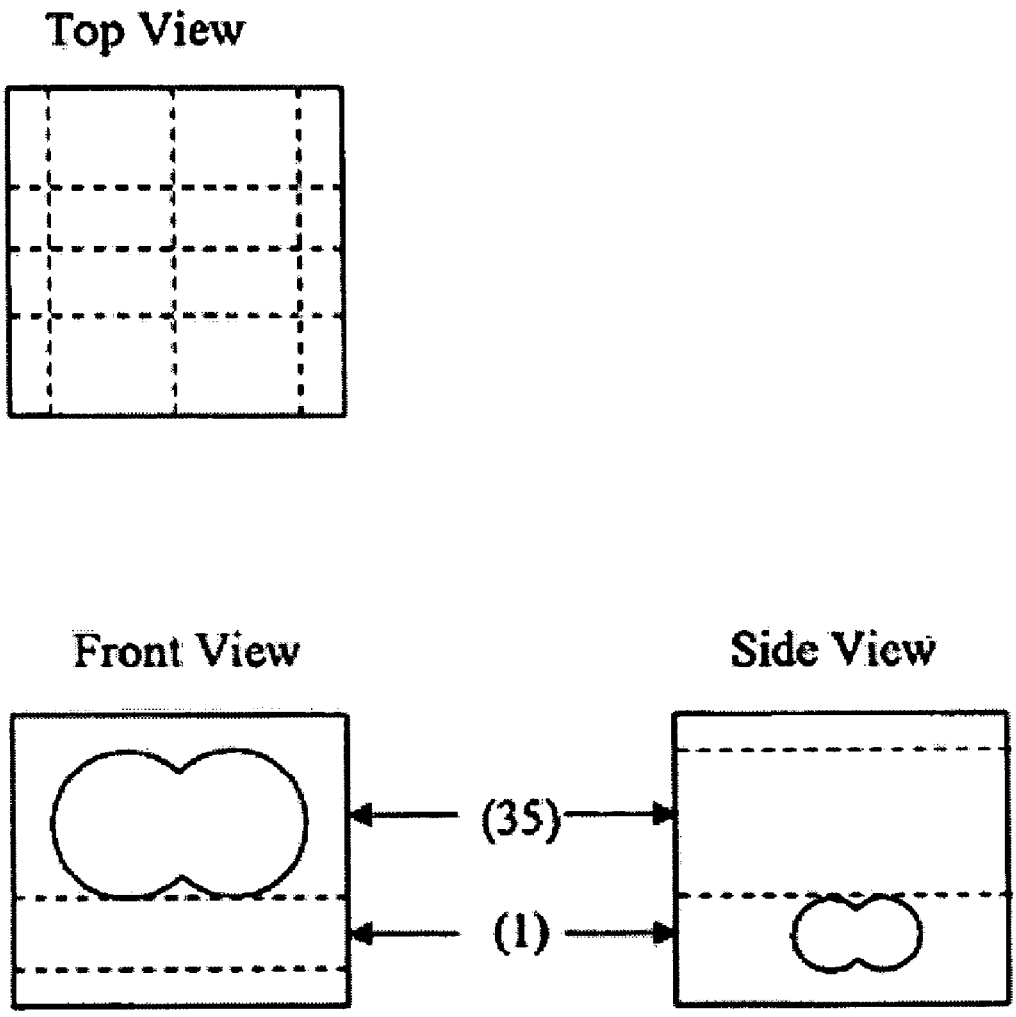
FIG. 7 shows one way material can be transferred positively between two extruders according to an embodiment of the invention.

Extruders (1) and (35) are joined in a barrel cross (39) wherein the two sets of screws overlap as illustrated in FIG. 7, which shows one way material can be transferred positively between two extruders. Screws from two extruders overlap in close proximity with the barrel metal between them removed to allow material being processed to be forced from one extruder into the other. Alternatively, one extruder can feed into the side of another in a "T" arrangement, where a first threaded shaft of a first extruder is coupled perpendicularly to a second threaded shaft of a second extruder in a perpendicular arrangement of the barrel units for the first and second shaft, and where the first shaft forces material into the second shaft. In this way, solids may be fed from one extruder to the next.

The next motor driven extruder (36) in FIG. 6 maintains the dynamic plug (7) and its associated input and discharge of liquids. This extruder can again be a small, high-speed type and is fed by the barrel cross (40). The motor driven extruder (37) fed by a barrel cross (41) in FIG. 6 is again a large extruder (similar to (35)) optimized for its function as two reaction zones (4) and (5) along with a concentrated alkali feed (21). This extruder, in turn, feeds through a barrel cross (42) to a final, small, motor-driven extruder (38) that maintains a third dynamic plug (8) as well as input and output features.

This extruder (37) may differ in operation from the apparatus of FIG. 1: Rather than a single, hot, rinse water input (19) preceding the final plug (8), an elongated barrel section (43) is provided to cool solids before discharge. A portion of required rinse water (34) is input cold. In this way, the temperature of the plug (8) can be reduced below the boiling point, and the rinsed solids discharged directly with moisture content less than 50%. In some applications this can result in significant cost reduction by eliminating the need for a separate liquid/solid separation step. In addition, the counter-flowing cold rinse water recovers heat from the discharging solids thereby improving the energy efficiency of the operation of the system.

Having described several embodiments, it will be recognized by those of skill in the art that various modifications, alternative constructions, and equivalents may be used without departing from the spirit of the invention. Additionally, a number of well known processes and elements have not been described in order to avoid unnecessarily obscuring the present invention. Accordingly, the above description should not be taken as limiting the scope of the invention.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the electrode" includes reference to one or more electrodes and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. An apparatus to separate components of a solid feedstock, the apparatus comprising:

a threaded shaft comprising a plurality of reaction zone segments along the length of the shaft that are separated from each other by dynamic plug segments, wherein the threads of the shaft have a first thread pitch in the reaction zone segments, and a second thread pitch that is less than the first thread pitch in the dynamic plug segments;

a motor coupled to a first end of the threaded shaft to rotate the shaft, and an outlet coupled to a second end of the shaft that is opposite the first end, wherein the solid feedstock moves in a direction from the first to the second end of the shaft when the motor rotates the shaft, and one or more solid components of the solid feedstock exit the apparatus through the outlet;

a barrel unit to contain the threaded shaft;

a feeder to supply the solid feedstock to the threaded shaft, wherein the solid feedstock from the feeder first contacts the threaded shaft at a first reaction zone segment that is closest to the first end of the shaft;

a pump to provide a rinse fluid to the threaded shaft, wherein the rinse fluid flows in the opposite direction of the solid feedstock along the shaft; and a pressurized discharge unit coupled to the outlet of the apparatus, wherein discharge unit comprises a progressing cavity pump running in reverse that discharges solid product components with controlled pressure reduction.

2. The apparatus of claim 1, wherein the apparatus further comprises a dynamic filter to capture particles from a portion of the rinse fluid coming off the shaft, and return the particles to the threaded shaft.

3. The apparatus of claim 2, wherein the dynamic filter is coupled to a discharge unit that receives the rinse fluid from the dynamic filter and discharges a fluid mixture containing smaller particles with controlled pressure reduction.

4. The apparatus of claim 1, wherein the apparatus comprises a heater to heat the rinse fluid provided to the threaded shaft.

5. The apparatus of claim 1, wherein the apparatus comprises a heat exchanger coupled to the pump and the dynamic filter to transfer a portion of the heat from the rinse fluid coming off the shaft to new rinse fluid provided to the shaft by the pump.

6. The apparatus of claim 1, wherein the solid feedstock comprises lignocellulosic biomass and the rinse fluid comprises water.

7. A system to treat a solid feedstock, the system comprising:

a plurality of threaded shafts including a first shaft with solids feeder and a final shaft coupled to an outlet, wherein the solid feedstock moves in a direction from the first shaft to the final shaft, where one or more solid components of the solid feedstock exit the system through the outlet; and wherein at least one of the plurality of threaded shafts has one or more reaction zone segments along the length of the shaft that are defined by dynamic plug segments, wherein the threads of the shaft have a first thread pitch in the reaction zone segments, and a second thread pitch that is less than the first thread pitch in the dynamic plug segments, a motor coupled to each of the plurality of threaded shafts to rotate the shaft, barrel units to contain the threaded shafts, a feeder to supply the solid feedstock to the first shaft; and a pump to provide a rinse fluid to one or more of the plurality of the threaded shafts, wherein the rinse fluid flows in the opposite direction of the solid feedstock along the shafts.

8. The system of claim 7, wherein the first shaft is coupled to a second threaded shaft by a barrel cross where ends of the first and second shaft overlap to permit the solid feedstock to move from the first shaft to the second shaft.

9. The system of claim 7, wherein the first threaded shaft is coupled perpendicularly to a second threaded shaft by a perpendicular arrangement of the barrel units for the first and second shaft, and wherein the first shaft forces material into the second shaft.

10. The system of claim 7, wherein the system comprises discharge units coupled to the liquid and solid outlets to provide for product removal while maintaining system pressure within acceptable limits.

11. An apparatus to separate components of a solid feedstock, the apparatus comprising:

a threaded shaft comprising a plurality of reaction zone segments along the length of the shaft that are separated from each other by dynamic plug segments, wherein the threads of the shaft have a first thread pitch in the reaction zone segments, and a second thread pitch that is less than the first thread pitch in the dynamic plug segments;

a motor coupled to a first end of the threaded shaft to rotate the shaft, and an outlet coupled to a second end of the shaft that is opposite the first end, wherein the solid feedstock moves in a direction from the first to the second end of the shaft when the motor rotates the shaft, and one or more solid components of the solid feedstock exit the apparatus through the outlet;

a barrel unit to contain the threaded shaft, a feeder to supply the solid feedstock to the threaded shaft, wherein the solid feedstock from the feeder first contacts the threaded shaft at a first reaction zone segment that is closest to the first end of the shaft;

a pump to provide a rinse fluid to the threaded shaft, wherein the rinse fluid flows in the opposite direction of the solid feedstock along the shaft; and a pressurized discharge unit coupled to the outlet of the apparatus, wherein discharge unit comprises a pressurizable hydrolyic accumulator in fluid communication with a first and second valve that control the introduction of the solid components to a flash tank.

* * * * *